US005757406A

United States Patent [19]

Kaplinsky et al.

[11] Patent Number: 5,757,406

[45] Date of Patent: May 26, 1998

[54] NEGATIVE PRESSURE INK DELIVERY SYSTEM

[75] Inventors: George Kaplinsky, San Diego; David W. Swanson, Escondido, both of Calif.; James E. Clark, Albany, Oreg.; Tofigh Khodapanah, San Diego, Calif.

[73] Assignee: Hewlett-Packard Company, Palo Alto, Calif.

[21] Appl. No.: 995,851

[22] Filed: Dec. 23, 1992

Related U.S. Application Data

[63] Continuation-in-part of Ser. No. 929,615, Aug. 12, 1992, abandoned.

[51] Int. Cl.[6] ..... B41J 2/175

[52] U.S. Cl. ..... 347/87

[58] Field of Search ..... 346/1.1, 140 R; 141/1, 2, 18; 347/86, 87

[56] References Cited

U.S. PATENT DOCUMENTS

| | | | |
|---|---|---|---|
| 4,412,232 | 10/1983 | Weber | 347/87 X |
| 4,422,084 | 12/1983 | Saito | 347/86 |
| 4,436,439 | 3/1984 | Koto | 347/87 X |
| 4,500,895 | 2/1985 | Buck | 347/87 |
| 4,509,062 | 4/1985 | Low | 347/87 |
| 4,571,599 | 2/1986 | Rezanka | 347/87 |
| 4,755,836 | 7/1988 | Ta | 347/87 X |
| 4,931,811 | 6/1990 | Cowger et al. | 347/87 |
| 4,992,802 | 2/1991 | Dion | 347/87 |
| 5,040,001 | 8/1991 | Dunn | 347/86 |
| 5,049,898 | 9/1991 | Arthur | 347/87 X |
| 5,280,300 | 1/1994 | Fong et al. | 347/87 |
| 5,325,119 | 6/1994 | Fong | 347/86 |
| 5,359,353 | 10/1994 | Hunt et al. | 347/86 |
| 5,450,112 | 9/1995 | Scheffelin | 347/87 |
| 5,451,995 | 9/1995 | Swanson | 347/87 |
| 5,464,578 | 11/1995 | Salter | 264/250 |
| 5,491,502 | 2/1996 | Swanson | 347/87 |
| 5,515,092 | 5/1996 | Swanson | 347/87 |
| 5,541,632 | 7/1996 | Khodapanah | 347/87 |

FOREIGN PATENT DOCUMENTS

| | | | |
|---|---|---|---|
| A0379151 | 7/1990 | European Pat. Off. . | |
| A0437363 | 7/1991 | European Pat. Off. . | |
| A0490545 | 6/1992 | European Pat. Off. . | |
| 0519664 | 12/1992 | European Pat. Off. | B41J 2/175 |
| A0519664 | 12/1992 | European Pat. Off. . | |

*Primary Examiner*—Joseph W. Hartary
*Attorney, Agent, or Firm*—David S. Romney

[57] ABSTRACT

An inkjet printhead is mounted on a cartridge which has an outer casing member, an inner collapsible reservoir formed by non-elastic flexible walls, and an internal spring means inside the reservoir for creating negative pressure in the collapsible reservoir during the filling and storage of ink in the collapsible reservoir as well as during the dispensing of ink from the collapsible reservoir to the printhead.

27 Claims, 8 Drawing Sheets

14
13
16
19
24
B
60
51
50
41
40
30
18
25
21b
20
21a
18
22
B
12
10

NEGATIVE PRESSURE INK DELIVERY SYSTEM

CROSS REFERENCE TO RELATED APPLICATIONS

This application is a continuation-in-part of application COLLAPSIBLE INK RESERVOIR STRUCTURE AND PRINTER INK CARTRIDGE, George T. Kaplinsky, et al., Ser. No. 07/929,615, filed Aug. 12, 1992, now abandoned and refiled as Ser. No. 08/240,297, filed May 9, 1994.

The present application is related to the following pending U.S. patent applications: METHOD OF MAKING A COMPACT FLUID COUPLER FOR THERMAL INK JET PRINT CARTRIDGE INK RESERVOIR, U.S. Pat. No. 5,464,578, by James G. Salter, et al.; INK PRESSURE REGULATOR FOR A THERMAL INK JET PRINTER, U.S. Pat. No. 5,541,632, by Tofigh Khodapanah et al.; COLLAPSIBLE INK RESERVOIR STRUCTURE AND PRINTER INK CARTRIDGE, U.S. Pat. No. 5,541,632, by George T. Kaplinsky et al.; TWO MATERIAL FRAME HAVING DISSIMILAR PROPERTIES FOR A THERMAL INK-JET CARTRIDGE, U.S. Pat. No. 5,515,092, by David S. Swanson, et al.; RIGID LOOP CASE STRUCTURE FOR THERMAL INK-JET PEN, U.S. Pat. No. 5,451,995, by David W. Swanson, et al.; THERMAL INK-JET PEN WITH A PLASTIC/METAL ATTACHMENT FOR THE COVER, APPLICATION SER. NO. 07/994,810, by Dale D. Timm, Jr.; THIN PEN STRUCTURE FOR THERMAL INK-JET PRINTER, U.S. Pat. No. 5,491,502, by David W. Swanson et al.; DOUBLE COMPARTMENT INK-JET CARTRIDGE WITH OPTIMUM SNOUT, application Ser. No. 08/496,044, by David W. Swanson, et al.; LAMINATED FILM INK RESERVOIR, U.S. Pat. No. 5,450,112, by Joseph Scheffelin; SPRING BAG PRINTER INK CARTRIDGE WITH VOLUME INDICATOR, U.S. Pat. No. 5,359,353.

BACKGROUND OF THE INVENTION

This invention relates to thermal ink-jet (TIJ) printers, and more particularly to improvements in the pens used therein.

TIJ printers typically include a TIJ pen which includes a reservoir of ink coupled to the TIIJ printhead. One type of pen includes a polymer foam disposed within the print reservoir so that the capillary action of the foam will prevent ink from leaking or drooling from the printhead. In such a foam-pen, an air-vented delivery system is provided wherein air enters the reservoir via a separate vent opening to replace ink which is dispensed from the reservoir through the printhead.

A different type of TIJ printer has an ink reservoir which is ordinarily maintained under a sub-atmospheric or negative pressure so that ink will not leak or drool from the printhead. Various types of ink reservoirs may be used including refillable ink reservoir cartridges which are mounted on the moveable printer carriage, throwaway replaceable cartridges which are mounted on the printer carriage, and remote or offboard ink reservoirs from which ink is brought to the printhead on the printer carriage by tubing.

A collapsible ink reservoir for a handheld inkjet printer is disclosed in U.S. Pat. No. 4,422,084 issued Dec. 20, 1983 to Saito. Negative pressure is maintained in a polypropylene ink bag by various types of springs which bias the bag walls apart from each other. The springs may be mounted inside of or externally of the ink bag but the spring pressure regulator construction does not result in substantially complete emptying of the ink bag and the bag itself is not carried on a printer carriage.

Another ink reservoir which achieves constant negative back pressure through an external spring or an elastomeric bladder is disclosed in U.S. Pat. No. 4,509,062 issued Apr. 2, 1985.

BRIEF SUMMARY OF THE INVENTION

The invention provides an improved negative pressure ink reservoir incorporated into a cartridge for use in a printing device such as a TIJ printer/plotter, facsimile machine, or the like. The unique features of the invention affords many benefits. The cartridge itself is relatively thin in one direction, and can be mounted in various orientations on a printer/plotter carriage to take advantage of such thin dimension and provide a smaller footprint/spaceprint for the printer/plotter. The ink delivery system is simple and efficient. Ink is held in a substantially airtight reservoir formed by two oppositely positioned pieces of thin flexible non-elastic plastic-like material that have been attached by thermal bonding or other suitable technique to a compatible plastic material on a frame. A pressure regulator inside the reservoir includes two spring-loaded pistons in order to provide the necessary backpressure to prevent ink from drooling out of the printhead. The frame is preferably made of two different plastic materials. One material is an engineering plastic forming the external surfaces and providing structural support and the second material provides the fluid path for the ink and is suitable for thermal attachment to the bag material. Strong metal sidecovers attached to the frame help form an outer casing to provide a protective cover for the ink reservoir inside and to provide rigidity to the cartridge. The aforementioned spring/bag reservoir construction inside a compact strong outer casing achieves a high degree of volumetric efficiency (volume of deliverable ink compared to the external volume of the pen.

The various principal ink reservoir components in the cartridge are all attachable to each other along the same axis, thereby facilitating the manufacturing and assembly of the cartridges, including the spring assembly, bag walls, filters, and sidecovers. The spring assembly includes the spring plates, protective cover, and bowed spring which are also assembled together along a common axis for attachment.

DETAILED DESCRIPTION OF PREFERRED EMBODIMENTS

Figure 1:
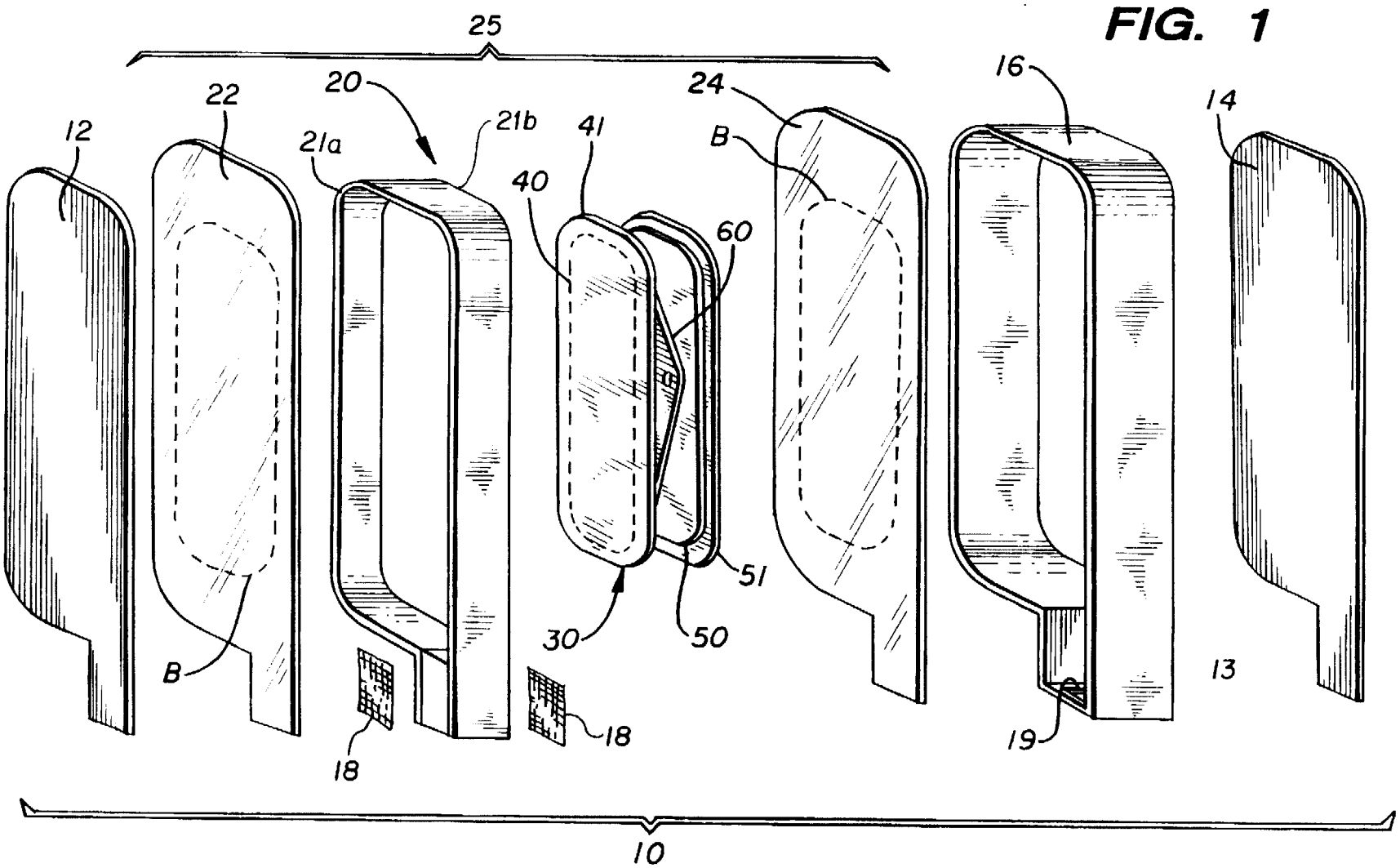
FIG. 1 is an exploded perspective view of a replaceable or throwaway ink cartridge of a presently preferred embodiment of the invention prior to assembly.

The drawing shows a replaceable ink cartridge comprising a rigid outer housing 10 having a pair of spaced cover plates 12, 14 intended to be affixed as by heat bonding, or adhesive, or preferably press fit through interlocking tabs to opposite sides of a plastic peripheral wall section 16. Snout portion 13 of the cartridge has an ink discharge aperture in its lowermost end wall (as seen in FIG. 1) to which is affixed an electrically driven print head, not shown.

An inner collapsible reservoir structure unit 5 comprised of a relatively rigid inner plastic frame 20 and a pair of ink bag sidewalls 22, 24, at least one of which is flexible membrane such as plastic, attached thereto is mounted in the outer housing 10. Preferably, inner frame 20 is molded with the outer housing 10 in a two step injection molding process. Inner frame 20 is formed of a softer and lower melting point plastic than the plastic of housing 10 to permit heat bonding of the bag walls 22, 24 thereto. Alternatively, inner frame 20 may be separately constructed with some flexibility to assist in mounting it in the housing 10 but the frame 20 is rigid relative to the flexible ink bag membranes described below.

The frame 20 has a pair of opposite side edges 21 to which the flexible plastic ink bag membranes 22, 24 are respectively joined as by heat welding at their peripheral edges to form the reservoir structure 25. The reservoir structure 25 contains a pressure regulator 30 which in turn is preferably comprised of a pair of spaced substantially parallel metal sideplates 40, 50 urged apart by a bow spring 60 toward the flexible membranes 22, 24. The assembled reservoir structure including the inner frame 20, membranes 22, 24 and pressure regulator 30 is then mounted inside of wall section 16 of the cartridge and side walls 12, 14 are then affixed to the cartridge housing peripheral wall 16. The snout portion 13 of housing 10 also contains an ink filter 18 which is placed in fluid communication with the flexible ink bag reservoir. The filter 18 may be mounted inside the reservoir structure or it can be positioned outside of the reservoir structure but inside outer housing 10 with minor porting and seal modifications to ensure fluid communication from the ink reservoir to the filter 18. The lowermost portion of the peripheral outer housing wall 16 (as viewed in FIG. 1) is provided with an ink discharge aperture 19 through which ink is downwardly discharged from the filter 18 to the print head, not shown.

The pressure regulator sideplates 40, 50 may be individually cut from a continuous metal strip of metal such as stainless steel, each plate being of generally rectangular configuration with rounded corners to minimize damaging the flexible bag membranes.

The bow spring 60 also may conveniently be cut from a common strip of metal such as stainless steel.

The bow spring 60 is affixed, preferably by spot or laser welding at the apexes of each of its bights centrally onto each of the sideplates 40, 50.

An edge guard in the form of a thin but tough polyethylene cover layer 41, 51 having an acrylic adhesive on one surface thereof may then be press bonded to the outer surface of each side plate 40, 50 if desired. The cover layers 41, 51 are each sized slightly larger than the side plates 40, 50 so that a marginal width of approximately 1.2 millimeters of the cover layers extends beyond each edge of the metal plates 40, 50 to prevent those edges from contacting the comparatively delicate plastic bag wall membranes 22, 24.

The pressure regulator 30 is centrally positioned in the frame 20 and housing 10 and the two flexible plastic ink bag sidewalls or membranes 22, 24 are then heat bonded or cemented at their peripheral edges to the edge wall 21 of the inner plastic frame 20, care being taken to maintain the central positioning at all times of the regulator and cover layers 41, 51 in the frame 20 between the flexible membrane walls 22, 24. The bag walls 22, 24 are then securely affixed to the pressure regulator 30 preferably by heat bonding the membrane bag walls 22, 24 to the cover layers 41, 51 in the area bounded by the broken line B. This heat bonding has the primary purpose of preventing relative motion between the pressure regulator 30 and preventing direct contact of the metal sideplates 40, 50 with the relatively delicate membrane bag walls 22, 24 to prevent the edges of the sideplates from cutting or puncturing the membranes. In the absence of any protective cover layers, the bag walls may be directly bonded by heat bonding or suitable adhesive to the pressure regulator. Either method of construction also reduces the area of ink contact with the membrane walls 22, 24 which in turn minimizes the migration of moisture from the ink through the membranes. Such migration, over time, degrades the ink quality and this problem is thus minimized. In one embodiment the dimensions of the dashed line area of heat bonding are approximately 8 mm by 29 mm. and the heat bond area is centrally located on the sideplates 40, 50. In another embodiment, the regulator side plates and bag sidewalls are initially assembled to be in moveable contact with each other. Thereafter, a heated platen momentarily contacts the film and fuses the film to the plate. A slight vacuum must be applied to the inside of the frame to improve the quality of the fusion.

As ink is withdrawn from the reservoir bag, the flexible sidewalls 22, 24 of the ink bag and the pressure regulator sideplates 40, 50 gradually move towards each other until the spring is in an essentially flat configuration with the two sideplates 40, 50 coming virtually into contact with each other so that the bag is substantially completely emptied of ink.

Persons skilled in the art will readily appreciate that various modifications can be made from the preferred embodiment thus the scope of protection is intended to be defined only by the limitations of the appended claims. For example, the cover layers 41, 51 may in some instances be unnecessary and an ink bag having a single flexible membrane wall instead of two flexible membrane walls might be constructed. In this instance, the pressure regulator need only have a single side plate urged into engagement by a spring with the single flexible membrane bag wall.

It is therefore understood from the foregoing description that the invention provides a bonding technique to assure that the regulator is centrally positioned and always held in its proper place between the flexible membrane bag walls, preferably by heat bonding of the bag walls to an edge guard layer covering the outer surface of the two side plates 40, 50.

In such a preferred embodiment of the invention, inadvertent puncture of the thin bag walls by the regulator is prevented by a protective edge guard in the form of a layer of tough plastic bonded to the outer surface of the side plates, the protective layers each having a peripheral edge which extends beyond the edge of the side plate to prevent the edges of the side plates from directly contacting the bag walls.

Figure 2:
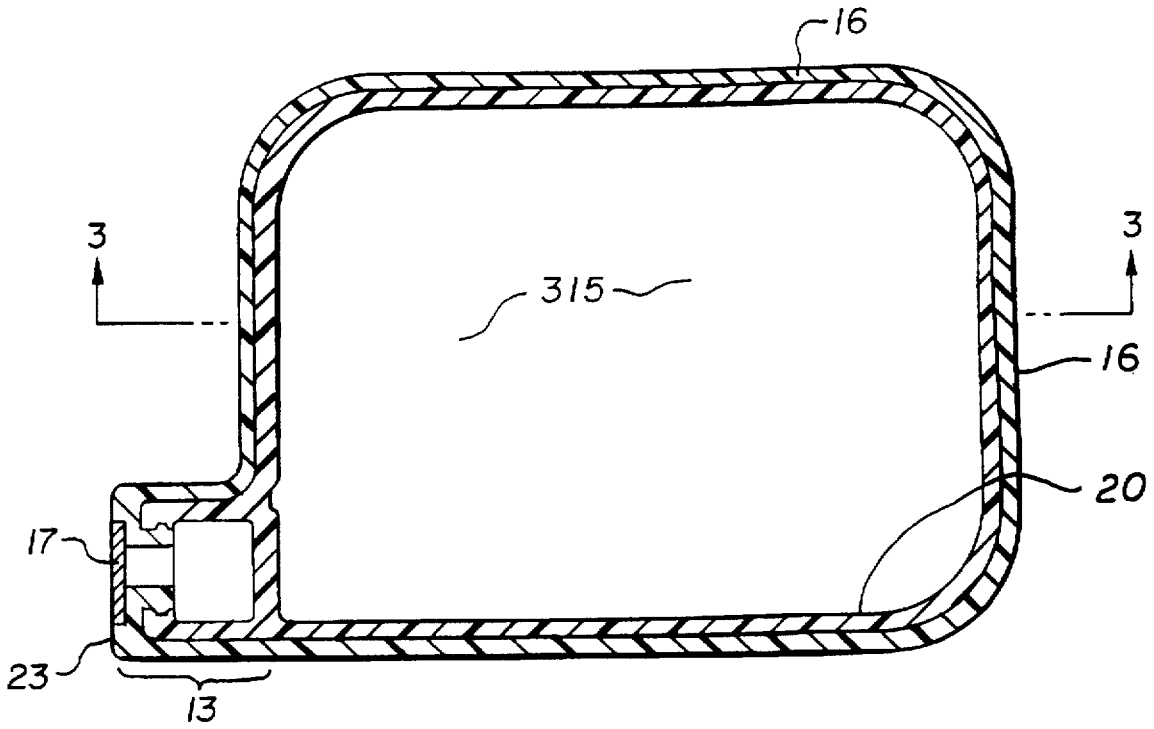
FIG. 2 is a sectional view taken along the line 2—2 of FIG. 3, with the spring assembly not shown.
Figure 3:
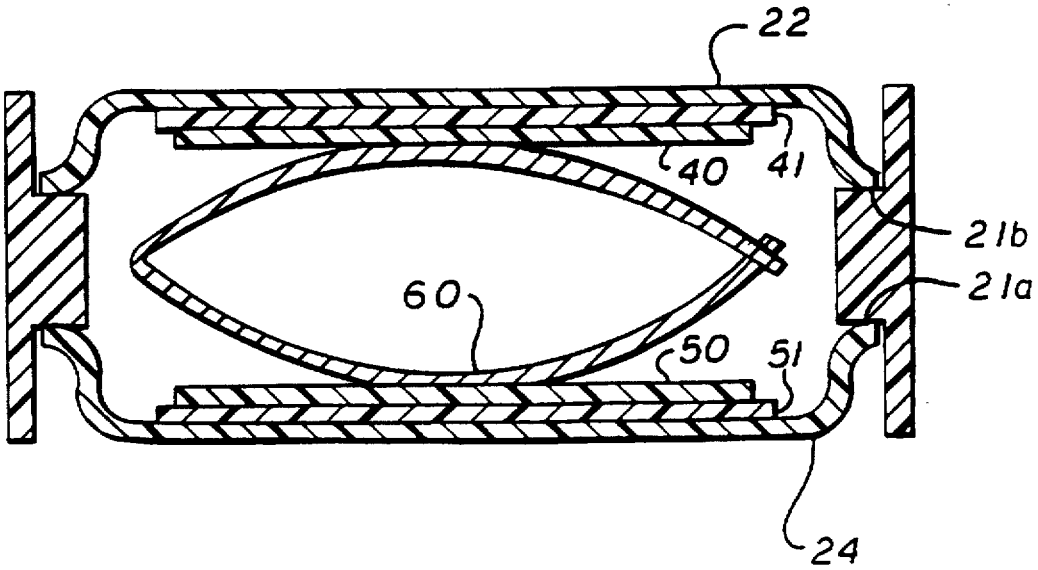
FIG. 3 is a cross-sectional view of the cartridge of FIG. 2, with partial enlargements at the sections shown thereon.

FIG. 2 illustrates a partially assembled ink cartridge embodying the invention, including an external pen case comprising a composite frame structure 16, 20 and a pair of side covers 12, 14. The frame structure defines an open area 315 for the ink reservoir. The pen snout 13 is formed at one corner of the cartridge, and a printhead 17 is attached at an end 21 of the snout 13. TIJ printheads are well known in the art, and include a plurality of orifice nozzles disposed in a printhead plane. In this exemplary embodiment, the nozzles eject ink droplets in a direction generally normal to the printhead plane.

Figure 6:
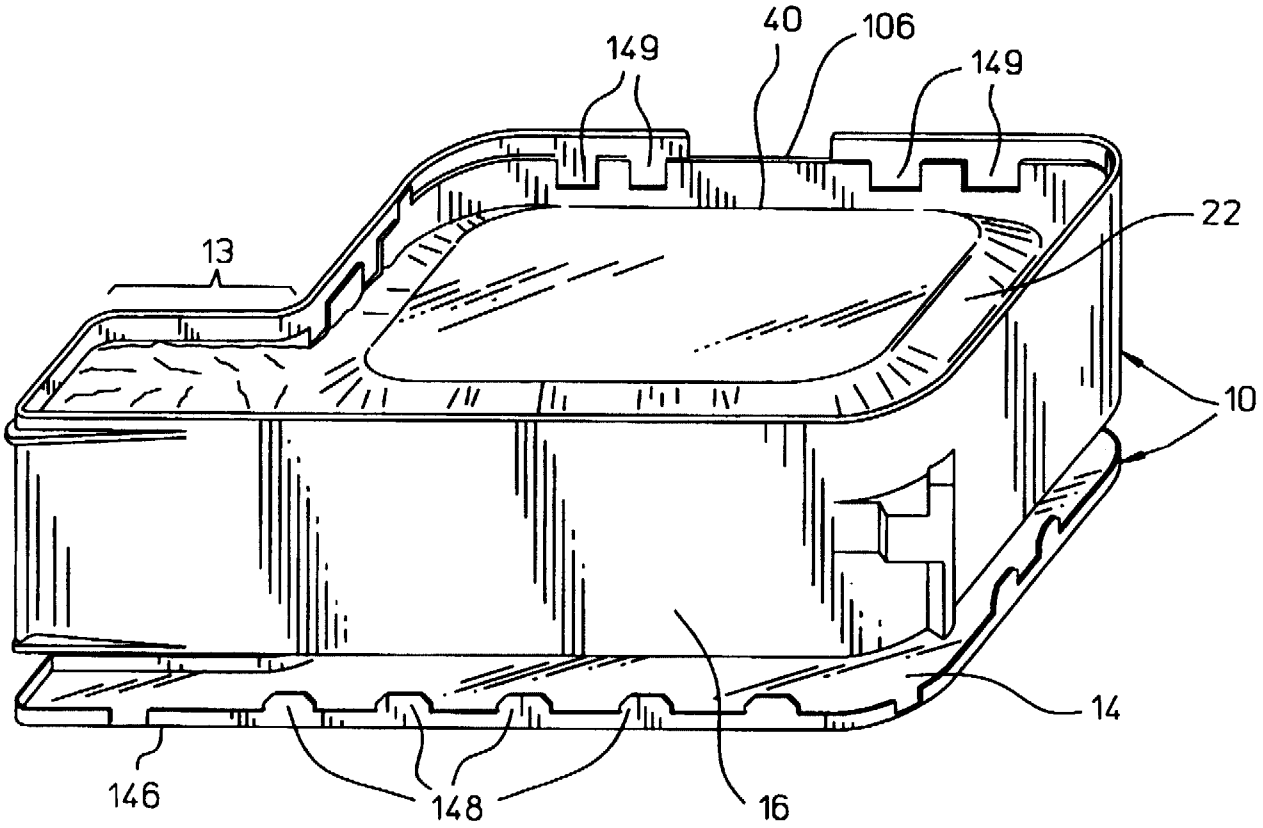
FIG. 6 is a closeup perspective view of the cartridge of FIG. 4 after assembly, with sidecovers removed.

The pressure regulator 30 is centrally positioned in the open area 315 of the inner peripheral frame 20 and the two flexible ink reservoir sidewalls 22, 24 are heat bonded or cemented at their peripheral edges to the outer edge walls 21 of the inner peripheral frame 20, with care being taken to maintain the central positioning at all time of the regulator in inner peripheral frame between the flexible sidewalls. The reservoir sidewalls may then be securely affixed to the sideplates, preferably by heat bonding in the area shown as 144. This heat sealing has the primary purpose of preventing relative motion between the pressure regulator 30 and the flexible sidewalls, as well as preventing direct contact of the metal sideplates 40, 50 with the relatively delicate reservoir sidewalls to prevent the edges of the sideplates from cutting or puncturing the sidewalls. As best shown in FIG. 6, each cover plate 146 is affixed to the outer peripheral frame through matching tabs 148 and slots 149.

The material used for reservoir sidewalls should be flexible, relatively puncture resistant, impermeable to moisture and chemically compatible and non-reactive with the ink contained therein to prevent leakage or migration of the ink out of the reservoir, and impermeable to external contaminants such as air, dust, liquids and the like.

The reservoir is filled with ink via port 122 which is subsequently plugged for shipment. The required means which fire the ink droplets through the orifices on the printhead is wall known in the art and causes progressive collapse of the spring reservoir such that its sidewalls both retract inwardly as the ink volume in the reservoir is decreased.

Figure 4:
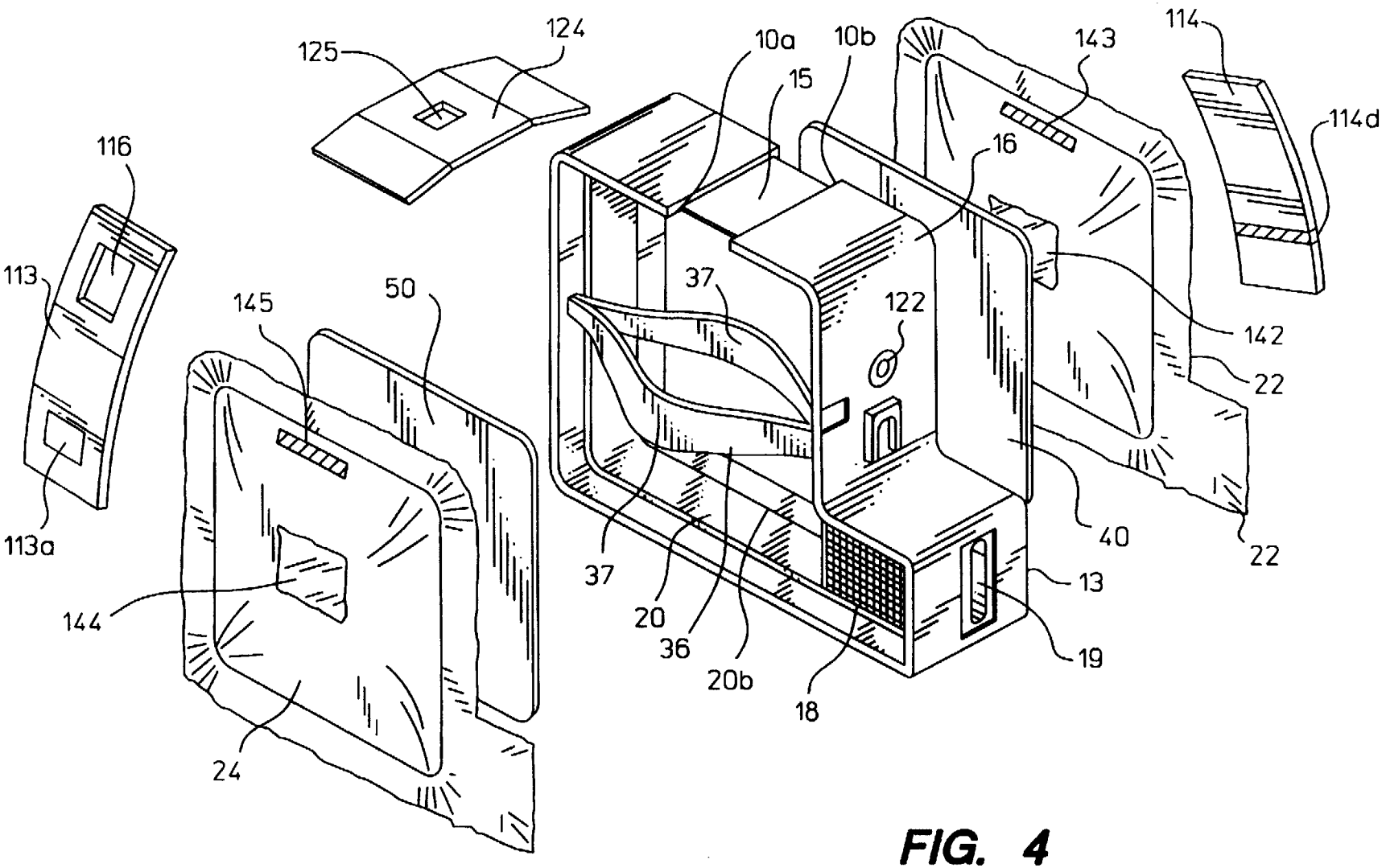
FIG. 4 is an exploded perspective view of another presently preferred embodiment of the the invention after assembly.
Figure 5:
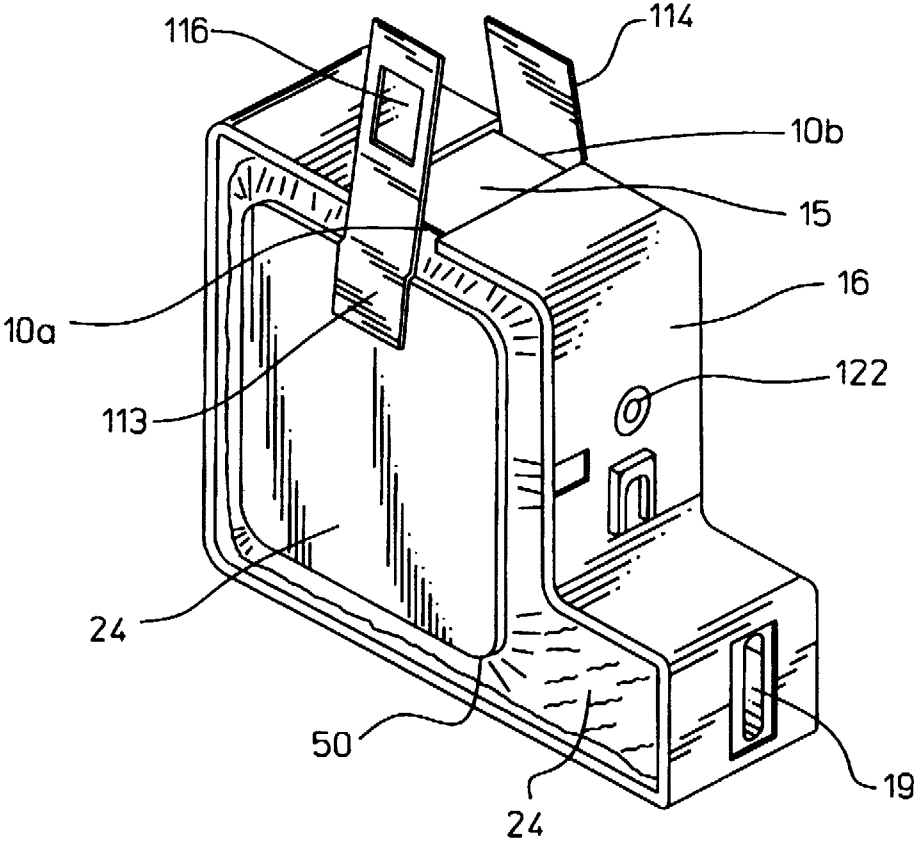
FIG. 5 is a perspective view of the cartridge of FIG. 4 after assembly, with sidecovers not shown.

Referring to FIGS. 4, 5 and 6, peripheral outer frame is provided with a pair of spaced parallel slots 1O*a* and 10*b* on opposite sides of reduced thickness channel 15. Cover plates include additional centrally located slots (not shown) aligned with slots 10*a*, 10*b*, respectively, to provide a passageway for ink level indicator strips 113 and 114 which are cemented or heated sealed to opposite reservoir sidewalls 124, 122, respectively. The joinder areas are shown as areas 142, 144 in FIG. 4. A window device 24 having a stationary viewing window 25 therein is placed over and aligned with the reduced thickness channel 15 to provide a passageway for movement of the indicator strips 113, 114.

Figure 7A:
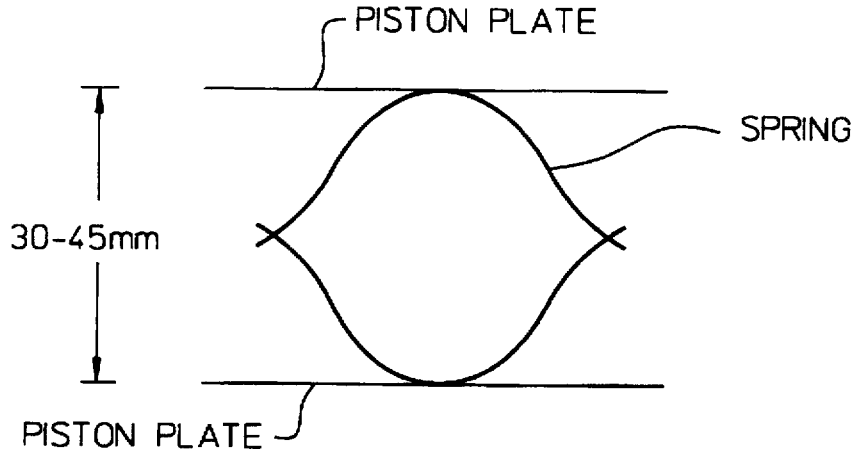
FIG. 7 schematically shows three stages of compression for the spring assembly of the present invention.
Figure 7B:
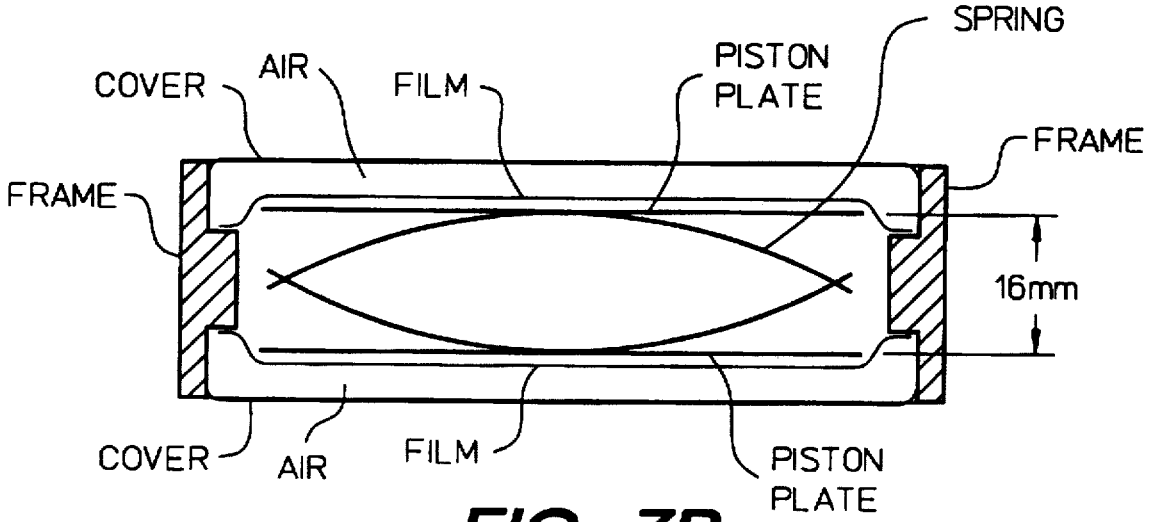
Figure 7C:
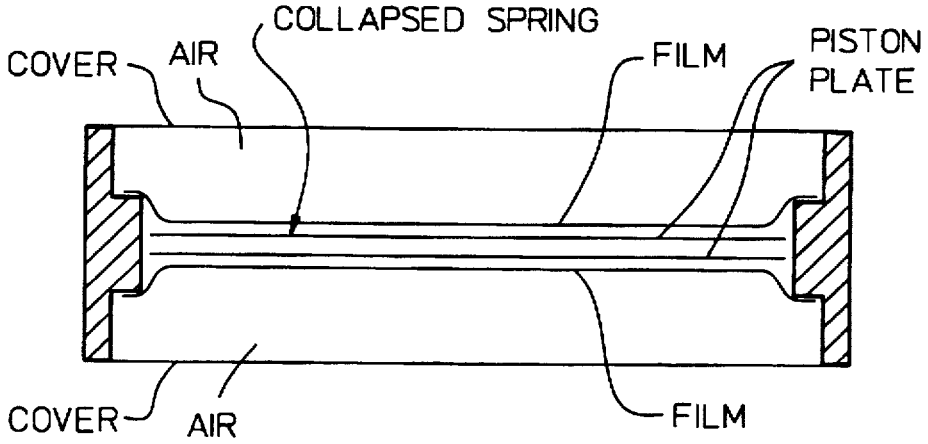

The schematic drawing of FIG. 7 shows how the spring assembly is preloaded inside the cartridge in order to optimize the range of negative pressure exerted by the spring during depletion of the ink from the reservoir. The actual negative pressure required of the spring is based on various factors, including the nozzle orifice architecture, the geometry of the cartridge (including the outer expansion limits of the reservoir as determined by the thickness of the cartridge), and the static ink head in the reservoir as determined by the horizontal/vertical orientation of the cartridge when mounted in printing position in the carriage. In this regard it is important to emphasize that when ink is supplied to the ink reservoir through inlet hole 122, the spring force exerted against the flexible walls of the ink reservoir must be calibrated to provide sufficient back-pressure (i.e., negative pressure) to prevent any prevent any undesirable leakage of the ink such as drooling through the printhead during cartridge storage, during cartridge installation on the carriage, or during operation on the carriage. Thus the flexible walls should not contact the sideplates of the casing or the rigid frame member after the filling operation is completed, as best shown in the "pre-loaded" middle drawing of FIG. 7.

Figure 9:
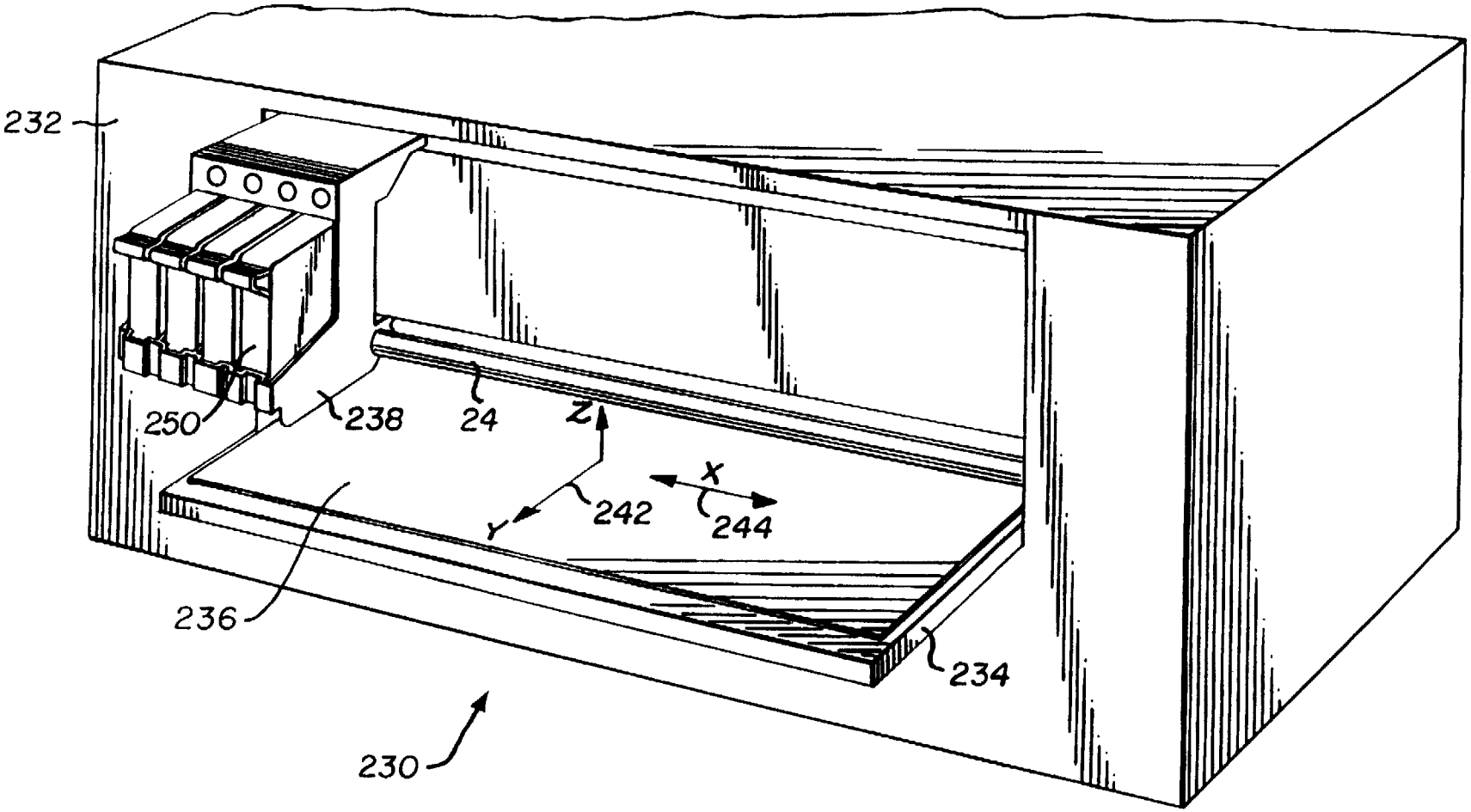
FIG. 9 is a perspective view showing multiple cartridges of the present invention mounted for use in a printer/plotter.

FIG. 9 illustrates a preferred embodiment of a TIJ printer incorporating a cartridge mounted in an upright position with the longest dimension of the cartridge in the Z axis, the intermediate dimension of the cartridge in the Y axis, and the thinnest dimension of the cartridge in the X axis. The printer includes a housing 232 which supports various elements including a platen 234 which supports as print medium 236 such as a sheet of paper. The printer includes a pen carriage 238 which is driven along a support shaft 40 to eject drops of ink from the pens 250 onto the print medium. As is well known in the art, the printer further includes media advancement mechanisms not shown to advance the medium in the Y direction arrow 242 along the medium advancement axis to position the medium for the next successive transverse swath carried out by the carriage 238 along the scan axdis 244. According to one aspect of the invention, the carriage 238 holds a plurality of thin pens 250, and is relatively narrow due to the thinness of the pens along the X direction 244 of carriage movement. As a result, the required width of the printer 230 can slo be relatively smaller than in prior designs. Further, the depth dimension of the pen is smaller than the height dimension, thereby minimizing the pen footprint while providing a high volume pen. This permits further a reduction in the printer footprint size.

Figure 8:
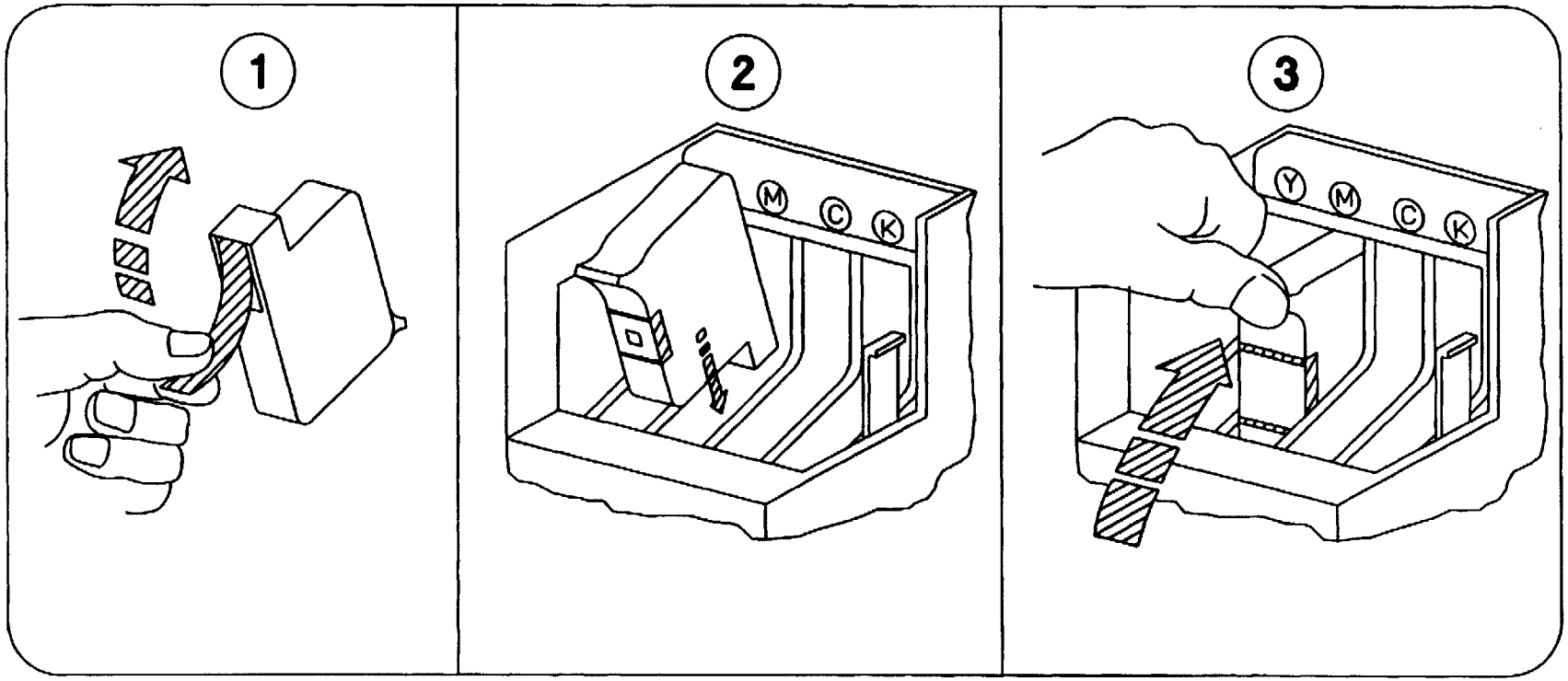
FIG. 8 shows three steps for installing the aforesaid cartridge in a multi-pen carriage.

In the preferred embodiment, the carriage 238 includes compartments adapted to carry four pens, each of a different color, as for example black, cyan, magenta and yellow. The pens are secured in a closely packed arrangement and may be selectively removed from the carriage for replacement with a fresh pen (see FIG. 8). The printheads of the pens are exposed through openings in the pen compartments facing the print medium.

While the aforementioned exemplary embodiments are TIJ cartridges, the invention is adaptable for use with other print cartridges which incorporate an ink reservoir as part of the cartridge. Similarly, the invention is not limited to a two-material frame but would be adaptable to any unitary or composite frame member such that a flexible membrane could be heat staked, glued, bonded, or sealed by compression or the like to the frame.

Although specific embodiments of the invention have been shown and described, it will be understood by those skilled in the art that various modifications and revisions can be made without departing from the spirit and scope of the invention as defined in the following claims.

We claim as our invention:

1. A print cartridge for ink having an ink reservoir incorporated as part of the cartridge, comprising:

an outer casing member;

a printhead;

a reservoir member attached to an inside portion of said outer casing member, said reservoir member including a pressure regulator inside the reservoir, the regulator comprising internal spring means, first and second flexible, virtually non-elastic walls, and first and second opposed plates which transfer force from said internal spring means to said first and second walls, said internal spring means acting on said flexible walls for creating negative pressure while ink is inside of said reservoir, wherein the pressure regulator maintains a range of negative pressure during depletion of ink from the reservoir sufficient to prevent undesirable drooling of ink from the printhead during cartridge storage and operation while permitting ink to be elected from the printhead during cartridge printing operations;; and wherein said first and second flexible walls are adapted to move from a full reservoir position through a partially collapsed reservoir position as ink is drawn from said reservoir through said printhead while maintaining said reservoir member as an airtight compartment.

2. The print cartridge of claim 1 wherein said outer casing member further includes a snout portion for carrying a printhead, said snout defining a passageway from said reservoir to said printhead.

3. The print cartridge of claim 2 wherein said snout includes a filter in said passageway.

4. The print cartridge of claim 1, further comprising a supply of liquid ink within said reservoir member.

5. A print cartridge comprising:

a casing member mountable in a printing device and having an inside portion;

a printhead on said casing member;

collapsible reservoir means attached to said inside portion of said casing and communicating with said printhead for storing ink in an airtight compartment comprising said reservoir, said collapsible reservoir means including first and second non-resilient, flexible walls, said reservoir means having a pressure regulator inside the reservoir, the regulator comprising internal spring means and first and second opposed plates which transfer forces from the spring means to the flexible walls for acting on said collapsible reservoir means and creating negative pressure in said collapsible reservoir means while ink passes from said collapsible reservoir means to said printhead, wherein the pressure regulator maintains a range of negative pressure during depletion of ink from the reservoir sufficient to prevent undesirable drooling of ink from the printhead during cartridge storage and operation while permitting ink to be ejected from the printhead during cartridge printing operations, said collapsible reservoir means adapted to move from a full reservoir position through a partially empty reservoir position to a virtually empty reservoir position as ink passes from said collapsible reservoir means to said printhead.

6. The print cartridge of claim 5 wherein said casing member defines an outer boundary for said collapsible reservoir means, said outer boundary having a plurality of concave corners.

7. The print cartridge of claim 6 wherein said internal spring means includes at least one plate with a perimeter shape corresponding to said outer boundary.

8. The print cartridge of claim 7 wherein said expandable reservoir means is can hold ink during normal printing operation without said expandable reservoir having to contact said casing member.

9. The print cartridge of claim 6 which further includes snout means extending outwardly from a corner of said outer boundary for defining a passageway to a printhead on the cartridge.

10. The print cartridge of claim 9 wherein said snout means includes a filter in said passageway.

11. The print cartridge of claim 5 wherein said collapsible reservoir means includes a flexible film which is virtually nonelastic.

12. The print cartridge of claim 5, further comprising a supply of liquid ink within said reservoir means.

13. An ink jet printer comprising:

a housing;

carriage means positioned on said housing over a print zone for mounting print cartridges; and a print cartridge including a printhead and collapsible reservoir means for holding liquid ink in a virtually airtight compartment, said collapsible reservoir including first and second flexible, virtually non-elastic walls, said collapsible reservoir means further including an internal spring member for acting on said collapsible reservoir means through opposed first and second flat plate members and creating negative pressure in said collapsible reservoir means, wherein the pressure regulator maintains a range of negative pressure during depletion of ink from the reservoir sufficient to prevent undesirable drooling of ink from the printhead during cartridge storage and operation while permitting ink to be ejected from the printhead during cartridge printing operations, said first and second flexible walls adapted to move toward each other from a full reservoir position through a partially collapsed reservoir position as ink passes from said collapsible reservoir means to said printhead.

14. The ink jet printer of claim 13 wherein said cartridge means can simultaneously mount at least two of said print cartridges.

15. The ink jet printer of claim 13 wherein at least two of said print cartridges hold different colored ink.

16. The ink jet printer of claim 13 further comprising a carriage scanning apparatus for moving said printer carriage along a carriage scan axis.

17. The ink jet printer of claim 16 wherein said printer carriage further comprises means for holding a plurality of said ink-jet pens, and said printing system includes a plurality of said print cartridges.

18. The ink jet printer of claim 16 wherein said printing system includes a media path through which a print medium is advanced through said print zone, said carriage scan axis is transverse to said media path at said print zone, and said printing system further includes a media advancing apparatus for incrementally advancing the print medium to the print zone for swath printing by said printer.

19. The ink jet printer of claim 13, further comprising a supply of liquid ink within said collapsible reservoir means.

20. An ink cartridge comprising:

a frame member;

a printhead;

a reservoir for holding ink, said reservoir including first and second flexible, non-elastic walls which move toward each other as ink is depleted from the reservoir through the printhead; and a spring member including a spring acting on first and second opposed plates to transfer force to said first and second wall members tending to oppose said movement of said first and second walls to create negative pressure while ink is inside said reservoir to prevent undesirable drooling of ink from the printhead during cartridge storage and operation while permitting ink to be ejected from the printhead during cartridge printing operations, wherein said frame member, said first and second plates and said reservoir are assembled together along substantially a common axis for attachment to each other.

21. The ink cartridge of claim 20 wherein said reservoir member includes at least one flexible wall member.

22. The ink cartridge of claim 20 wherein said spring member includes a spring and at least one plate attached to said spring along said common axis.

23. The ink cartridge of claim 20 which further includes at least one filter member.

24. The ink cartridge of claim 20, further comprising a supply of liquid ink disposed within said reservoir member.

25. A method of filling a print cartridge with ink, including the steps of:

providing an ink reservoir on the print cartridge, the ink reservoir having first and second flexible, virtually non-resilient wall portions which are adapted to move toward each other from a full reservoir position through a partially collapsed reservoir position while maintaining said reservoir member as an airtight compartment;

including a pre-loaded spring member positioned inside the ink reservoir for acting on said flexible wall portions through respective first and second plates;

supplying ink to the ink reservoir; and creating with the pre-loaded spring member a negative pressure in the ink reservoir to avoid undesirable leakage of ink while preventing the flow of air into the reservoir and to prevent undesirable drooling of ink from the printhead during cartridge storage and operation while permitting ink to be ejected from the printhead during cartridge printing operations.

26. The method of claim 25 wherein said supplying step is accomplished through an inlet separate from any orifice nozzles on a printhead of the cartridge.

27. A method of ink-jet printing using a cartridge having a negative pressure regulator, comprising:

providing an ink-jet cartridge comprising an outer casing member, a reservoir member attached to an inside portion of said outer casing member, said reservoir member including internal spring means and first and second flexible wall means coupled to said internal spring means, said internal spring means acting on said flexible wall means through first and second flat plates for creating negative pressure while ink is inside of said reservoir to prevent undesirable drooling of ink from the printhead during cartridge storage and operation while permitting ink to be ejected from the printhead during cartridge printing operations, and wherein said first and second flexible wall means are adapted to move toward each other from a full reservoir position through a partially empty reservoir position as ink is drawn from said reservoir while maintaining said reservoir member as an airtight compartment, and a printhead including firing chambers;

providing a supply of ink in said ink reservoir;

passing ink from said reservoir through said firing chambers, with said internal spring means collapsing as ink is withdrawn from said reservoir and passed through said firing chambers.

* * * * *

UNITED STATES PATENT AND TRADEMARK OFFICE

CERTIFICATE OF CORRECTION

PATENT NO. : 5,757,406

DATED : May 26, 1998

INVENTOR(S) : Kaplinsky et al.

It is certified that error appears in the above-indentified patent and that said Letters Patent is hereby corrected as shown below:

At Column 1, line 42, delete "TIIJ" and insert in lieu thereof --TIJ--.

At Column 2, line 55, delete "closeup" and insert in lieu thereof --close-up--.

At Column 5, line 29, delete "wall" and insert in lieu thereof --well--.

At Column 5, line 39, delete "heated" and insert in lieu thereof --heat--.

At Column 5, line 60, after "pressure)" delete "prevent any".

At Column 6, line 15, delete "axdis" and insert in lieu thereof --axis--.

At Column 6, line 20, delete "slo" and insert in lieu thereof --also--.

At Column 6, line 64, deleted "elected" and insert in lieu thereof --ejected--.

UNITED STATES PATENT AND TRADEMARK OFFICE

CERTIFICATE OF CORRECTION

PATENT NO. : 5,757,406

DATED : May 26, 1998

INVENTOR(S) : Kaplinsky et al.

It is certified that error appears in the above-indentified patent and that said Letters Patent is hereby corrected as shown below:

At Column 6, line 65, after "operations", delete --;

Signed and Sealed this

FourthDay of August, 1998

Bruce Lehman

*Attest:*

BRUCE LEHMAN

*Attesting Officer*

*Commissioner of Patents and Trademarks*